US005327877A

United States Patent [19]

Shaw, III

[11] Patent Number: 5,327,877

[45] Date of Patent: Jul. 12, 1994

[54] DUAL ARROW OVERDRAW SYSTEM

[76] Inventor: Francis W. Shaw, III, 2044 E. State, Huntington, Ind. 46750

[21] Appl. No.: 967,006

[22] Filed: Oct. 27, 1992

[51] Int. Cl.[5] ..... F41B 5/22

[52] U.S. Cl. ..... 124/24.1; 124/44.5

[58] Field of Search ..... 124/23.1, 24.1, 25.5, 124/25.6, 25.7, 44.5, 86, 88

[56] References Cited

U.S. PATENT DOCUMENTS

| | | | |
|---|---|---|---|
| 2,600,250 | 6/1952 | Lake et al. | 124/24.1 |
| 2,801,625 | 8/1957 | Vose | 124/25.7 |
| 2,909,167 | 10/1959 | Fredrickson | 124/25.7 |
| 3,285,237 | 11/1966 | Wolfe . | |
| 4,324,221 | 4/1982 | Peck | 124/24.1 |
| 4,598,688 | 7/1986 | Paul et al. | 124/44.5 |
| 4,756,295 | 7/1988 | Guzzetta | 124/24.1 X |
| 4,791,907 | 12/1988 | Corley | 124/44.5 |
| 4,823,764 | 4/1989 | Knaack | 124/88 |
| 4,865,007 | 9/1989 | Saunders | 124/44.5 |
| 5,031,601 | 7/1991 | Gunter | 124/44.5 |
| 5,085,201 | 2/1992 | Tepper et al. | 124/44.5 |

*Primary Examiner*—Eric K. Nicholson
*Assistant Examiner*—John Ricci
*Attorney, Agent, or Firm*—Baker & Daniels

[57] ABSTRACT

A dual arrow overdraw system for drawing and releasing two arrows at once. Rotatable rollers are used to reduce the friction when the two arrows are released through the system. An adjustment mechanism permits variable overdraw of the arrows according to the needs of the archer. The flight path of each arrow is independently controllable by means of adjusting the relative location of the rotatable rollers.

18 Claims, 2 Drawing Sheets

DUAL ARROW OVERDRAW SYSTEM

BACKGROUND OF THE INVENTION

The present invention relates generally to arrow supports or rests, and more particularly to an arrow rest system wherein two arrows may be overdrawn and released at the same time.

In recent years, the popularity of bow and arrow has increased dramatically both for use in hunting and in target competition. There have been developed many accessories for bows which are designed to meet the needs and demands for almost every user. Although there are many arrow rests known and used, they all have disadvantages. For example, most create friction between the arrow rest and the arrow, thus decreasing the arrow's potential maximum velocity. Some arrow rests prevent overdrawing of arrows, which is the ability to draw the arrow on the bow so that the arrowhead is behind the bow. The ability to overdraw arrows permits the use of shorter arrows and higher velocities.

One prior art arrow rest is shown in U.S. Pat. No. 4,791,907 that includes a pair of rubber O-rings of different diameters on a roller connected to the bow. This arrow guide permits the use of fishing arrows. The rotatable roller is useful in absorbing oscillations and lateral forces created in a fishing arrow shaft by the archery bow while reducing frictional loses between the arrow shaft and guide. A disadvantage with this arrow rest is that no overdraw is possible.

Another arrow support is shown in U.S. Pat. No. 5,031,601 which shows an arrow support having two rollers on separate arms to adequately control the arrow. This multi-port system permits overdraw of an arrow. Other overdraw systems basically consist of a trough behind the bow as in U.S. Pat. No. 4,589,688, which permits overdraw of the arrows. A problem with overdraw is that it is hard to instinctively shoot through the trough constructed and that the arrow guide sometimes increases the drag on the arrow.

A particular problem in hunting with a bow and arrow is that, after scoring a non-lethal hit on an animal, the hunter must follow the game through the woods to complete the kill. At times, this stalking results in long hours of traveling after the injured game or sometimes losing the animal in the wilderness.

The proposed solution is to target the game with two arrows at once. The ability to hit the game with two arrows would increase the tissue damage to the animal and spread out such damage over a larger area. This larger area would increase the chance of hitting a vital organ and of immediately dropping the animal.

There is therefore a need for a dual arrow overdraw system that is quiet and will create a minimum of friction with the arrows as they pass over the rest. There is also a need for such an arrow rest which can be easily installed on bows of all types and can be used for both right or left bows without modification of the arrow rest or the bow.

SUMMARY OF THE INVENTION

The dual arrow overdraw system of the present invention permits the archer to draw and release two arrows at once. The dual arrow guide utilizes rotatable rollers to reduce the friction when the arrows slide over the guide members. The roller members also are shaped to keep the arrows in a ready position prior to arrow release.

The invention also includes an overdraw aspect which permits the archer to use correspondingly shorter arrows to compensate for the increased inertia of shooting two arrows at once. These shorter arrows travel faster because of their lower air resistance compared to longer arrows.

In one aspect of the present invention, the dual arrow system is totally adjustable permitting the archer to vary the amount of overdraw desired since the device is easily attached to the bow. Additionally, each arrow is independently targetable depending on the type of shot required. The system may be preset to permit one arrow to fly left and one right, or even cross in mid air. Vertical adjustment of the arrow is created automatically, as known in the art, by changing location of the nock on the bow string.

An advantage of the dual arrow system of the present is that it permits an archer to shoot two arrows at once thereby increasing the likelihood of a fatal hit on targeted game.

Another advantage of the present invention is that the overdraw system permits the use of shorter arrows thereby compensating for the energy required to shoot two arrows at once. The shorter arrows permit the arrows to fly as fast as a single arrow from the same bow.

Yet another advantage of the dual arrow system of the present invention is that the system may be adjusted to independently target the two arrows shot. Also the device is adjustable for either left or right handed bows.

The invention, in one form thereof, provides a dual arrow draw system for shooting two arrows at once. The system includes an archery bow and an arrow guide attached to the bow and adapted to guide two arrows at the same time. The guide includes two roller members adapted to support the two arrows. An adjustment means adjusts the roller members in horizontal and vertical directions.

In one aspect, the roller members comprise a pair of rollers having a circumferential inwardly tapered channel in which the sidewalls of the channel are adapted to guide the arrows during use.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
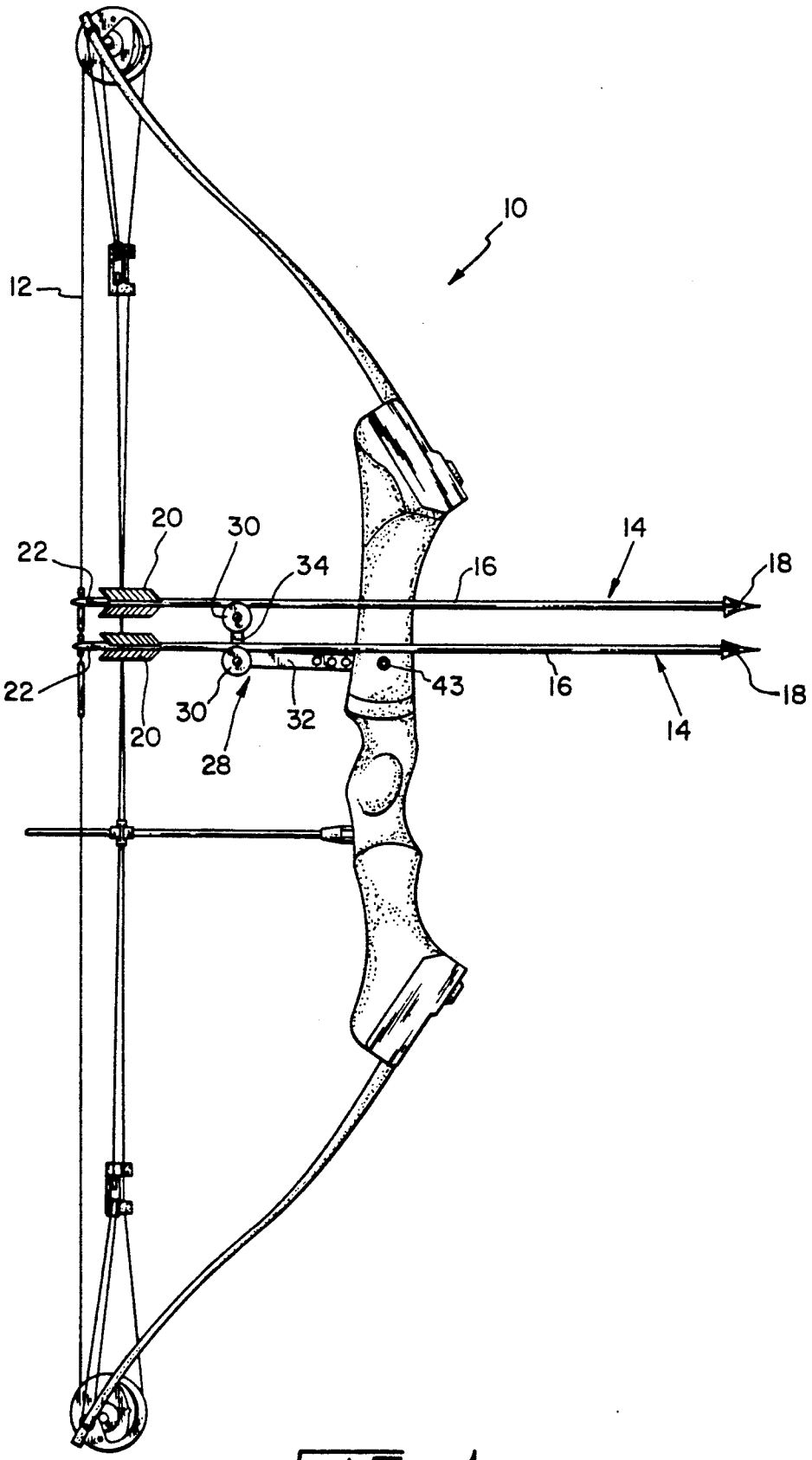
FIG. 1 is a side elevational view showing a typical compound bow having a dual arrow overdraw system and showing two arrows operatively connected to the bow and supported on the system.

Referring now to FIG. 1, there is a bow 10 having a bow string 12. Bow 10 is of the type commonly referred to as a compound bow. However, it should be noted that the present invention is adapted to be used with any bow and the present invention is not limited to any particular bow such as the compound bow shown in FIG. 1. Two arrows 14 having arrow shafts 16 are shown in FIG. 1 with arrow points 18 attached on one end of shaft 16 and a fletch 20 formed on an opposite end thereof with a nock 22 being formed on the end of arrow 14. In operation, the bow string 12 is inserted in nock 22 of arrow 14 and bow string 12 is drawn away from bow 10 to a position where bow string 12 is released, thereby discharging arrows 14 from bow 10 in a manner well known in the art.

It should be known that the term "fletch" as used here in connection with the fletch 20 and is intended to encompass all types of fletches, such as feathers or plastic vanes, for example. Further, fletch 20 may be a straight fletch or a helical fletch depending upon the application or desires of the shooter.

When an arrow 14 is discharged from bow 10, it is important that arrow 14 not oscillate or move up and down as it travels toward its target. Such oscillation causes the arrow to deviate from the desired path. Further, such oscillations also result in noise which is particularly undesirable when the bow and arrow are used in hunting situations.

The present invention consists of two rotatable members such as rollers 30 and 31 to support and stabilize the flight of arrows 14 while eliminating oscillations. Rollers 30 and 31 are connected to bow 10 by a mounting bracket 32.

Figure 2:
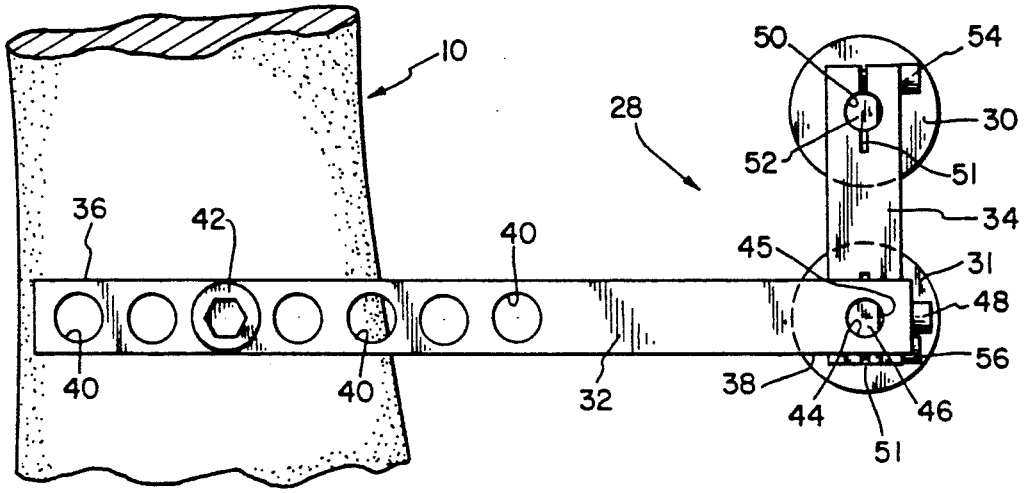
FIG. 2 is an enlarged side view of the dual arrow system.
Figure 3:
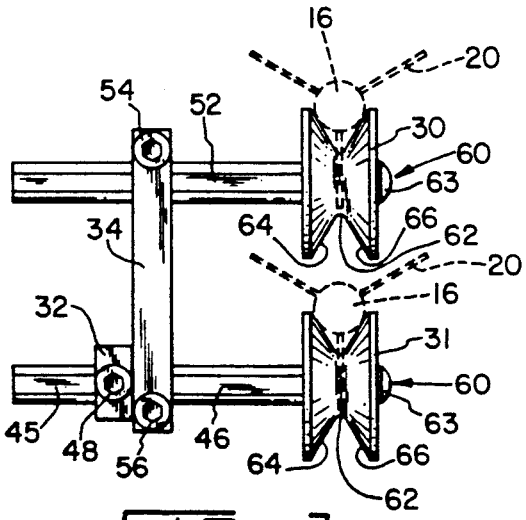
FIG. 3 is a rear elevational view of the dual arrow system as shown in FIG. 1.
Figure 4:
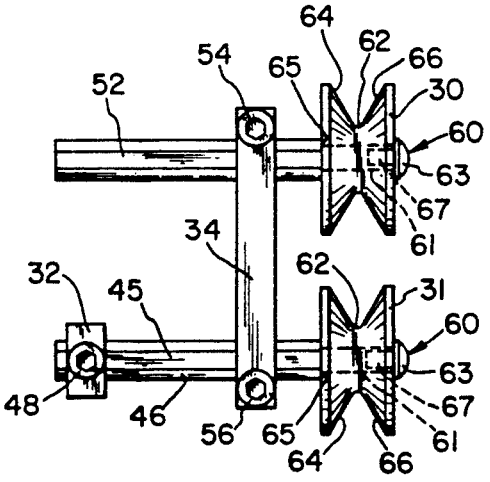
FIG. 4 is another rear elevational view of the dual arrow system shown adjusted into another position.

The dual arrow system 28 of the present invention is shown in more detail in FIGS. 2, 3, and 4. The dual arrow system 28 comprises a mounting bracket 32 attached to a support upright 34. The two rotatable rollers 30 and 31 are rotatably connected to support upright 34.

Mounting bracket 32 includes a front end 36 and a rear end 38. Along front end 36 of mounting bracket 32 are a plurality of holes 40 that permit an attaching bolt 42 to interfit through and threadedly attach to bow 10 through a threaded hole 43. Attaching bolt 42 may fit through any one of the plurality of holes 40 to adjustably attach the front end 36 of mounting bracket 32 to bow 10. By inserting attaching bolt 42 through different holes 40 and attaching bolt 42 through threaded hole 43, mounting bracket 32 is adjustably mounted to vary the distance of mounting bracket rear end 38 from bow string 12. This adjustment permits the overdraw distance to be changed. By properly selecting the amount of overdraw, arrows of different shaft lengths may be utilized. Furthermore, mounting bracket 32 may be attached to either the right or left side of bow 10.

Focusing now to the rear end 38 of mounting bracket 32 as shown in FIG. 2, there is a bore 44 into which a shaft 46 is interfit. Shaft 46 is slidable through bore 44 and lockable in a particular position by a lock screw 48 threaded through mounting bracket 32 into engagement with a flat 45 on shaft 46. Although shown only with one bore 44, bracket 32 may include more than one bore 44 to thereby locate shaft 46 at adjustable distances from bow 10.

Support upright 34 includes two vertically spaced bores 50. Into the lower bore 50 is interfit shaft 46 and into the top most bore 50, is interfit a shaft 52. Bores 50 are collapsible to tightly lock the shafts therethrough. Each of support upright 34 includes a split 51 in communication with bore 50. As shown in FIG. 2, shaft 52 interfits through top bore 50 may be locked to upright support 34 by a lock screw 54. Lock screw 54 attaches to support upright 34 first through a clearance hole (not shown) then past split 51, and then into a threaded hole (not shown) on the opposite side of support 34 relative split 51. As lock screw 54 is rotated, the size of split 51 is reduced, thereby reducing bore 50 and tightening support upright 34 to interfit shaft 52. In the same manner, upright support 34 may be fixedly attached to shaft 46 by another lock screw 56.

Rotatable members such as rollers 30 and 31 are attached to shafts 52 and 46 respectively by bolts 60. Rollers 30 and 31 are preferably made out of a light weight plastic, such as nylon, and are able to rotate upon their respective shafts with a low coefficient of friction. Rollers 30 and 31 rotate on a turned down section 61 of each shaft 46 and 52. Turned down sections 61 on which the rollers 30 and 31 rotate are smaller in diameter than shafts 46 and 52 thereby forming a shoulder 65.

To prevent axial movement of rollers 30 and 31 on shafts 61, the rollers are held in place on one side by bolt head 63 and on the other side by a shoulder 65 formed from turned down section 61 on shafts 46 and 52. A bolt 60 is threadedly attached to shaft 46 and 52 in a blind bore 67. Alternatively, other means may be provided to prevent axial movement of the roller elements 30 and 31 upon their respective shafts.

Each roller 30 and 31 includes an inwardly tapered circumferential channel 62 preferably having two inwardly sloping sidewalls 64 and 66. As shown in FIG. 3, channel 62 may also be described as a V-shaped notch, in which an arrow 14 rests within each roller element 30 and 31. Inwardly tapered channel 62 centers arrow 14 within each roller. Inward facing sidewalls 64 and 66 engage shaft 16 of each arrow 14 to hold the arrows prior to release. The rollers 30 and 31 also guide shafts 16 during arrow release. As arrows 14 are released, they move past rollers 30 and 31 causing the rollers to rotate about their shafts 61.

The relative locations of rollers 30 and 31 in relation to themselves and bow 10 may be changed as follows. To alter the overdraw characteristics of the bow, attachment bolt 42 may be withdrawn from a particular hole 40 and inserted into another hole 40 and then reattached to bow 10. This changes the relative distance between rollers 30 and 31 in regard to bow 10 and bow string 12. By altering the attachment point of mounting bracket 32 to bow 10, overdraw is controlled.

Vertical adjustment between rollers 30 and 31 is accomplished in the following fashion. Support upright 34 may be attached at a selected angle to mounting bracket 32 to cause arrows 14 to be released closer together in a vertical relationship as relative to bow 10. By either unthreading lock screw 56 to permit support upright 34 to selectively rotate relative shaft 46, or by unscrewing lock screw 48, thereby rotating shaft 46 within bore 44, relative adjustment between support upright 34 and mounting bracket 32 is accomplished. Support upright 34 rotates in the plane of bow 10. This causes rollers 30 and 31 to be locatable in different vertical positions relative bow 10. After rollers 30 and 31 are in the proper relative positions vertically, lock screws 56 and 48 are tightened to prevent movement.

For horizontal adjustment of roller 30 and 31, shafts 52 and 46 are adjusted within support upright 34 by lock screws 54 and 56. By unthreading lock screws 54, its associated shaft 52 may be slidingly adjusted through bore 50 such that rollers 30 and 31 do not necessarily line up in a vertical straight line. Shaft 46 may be adjusted horizontally by unthreading lock screw 48, then sliding shaft 46 through bore 44. This adjustment changes the horizontal displacement of roller 31 relative mounting bracket 32. With the adjustment of the rollers 30 and 31 either left or right, the trajectory and aim of each arrow 14 is changed. For additional adjustment, as is known in the art, arrows 14 having nocks 22 may be located at different locations upon bow string 12. By altering the location of the nocking of arrows 14 upon bow string 12, each arrow's aim is shifted. The rolling of rollers 30 and 31 along with the guiding provided by inward facing sidewalls 64 and 66 prevent unwanted arrow oscillations thereby causing the arrows 14 to fly straighter.

In operation, the archer will select the amount of overdraw required and attach mounting bracket 32 by means of attaching bolt 42 through a particular hole 40 and into bow 10, thereby obtaining the required amount of overdraw. Further, prior to use, the archer will adjust support upright 34 by tightening lock screws 48, 54, and 56.

During use, an archer will set two arrows 14, having shafts 16, within the inwardly tapered channel 62 of rollers 30 and 31. The archer will then nock arrows 14 to bow string 12. During drawing of the bow string, the archer will draw bow string 12 away from bow 10 thereby bringing arrow heads 18 past bow 10 into close proximity with roller elements 30 and 31. The archer will then shoot the arrows in a known fashion upon his target. During release, arrows 14 will move past rollers 30 and 31, causing them to spin. This spinning reduces the overall drag on arrows 14.

After a number of shots in which the archer has consistently pulled and released the draw string, the archer may adjust the relative landing points of the arrows by adjusting the locations of roller 30 and 31 as discussed previously. By adjusting rollers 30 and 31 either left or right and by adjusting their relative location vertically to one another by rotating support upright 34 relative mounting bracket 32, the arrow landing points may be controlled such that they land at predetermined distance apart. It has been found that targeting is easier with arrows 14 having helical fletches giving more consistent results.

During use, it is possible to cause the arrows to land a predetermined distance apart or to have the arrows land in a vertical relationship or even to have the arrows cross in mid air based upon the settings of the nocks 22, fletches 20 and roller elements 30 and 31.

The adjustability and adaptability of the system 28 permits a hunter to instinctively aim as is normally the case with the top arrow 14 and then based upon that arrow, permit the second arrow to land in a predetermined location. An example of such would be that when the hunter wishes to hit the game's heart and lung in the same shot. With a normal single arrow systems, the hunter would normally be limited to either hitting the heart or the lungs. With the present system, as described above, the user may target for the heart while having preset the dual arrow system 28 to aim the second arrow into the lungs thereby increasing the stopping power of bow 10 and dropping the animal with one release.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dual arrow draw system for shooting two arrows at once, said system comprising:

an archery bow;

an arrow guide attached to said bow, said guide adapted to guide two arrows at the same time, said guide including two roller members with peripheries spaced apart a distance greater than the diameter of an arrow, each roller member adapted to separately support an arrow in position for simultaneous release, independent from the other roller member.

The following is an Examiner's Statement of Reasons for Allowance: The type of rest shown by Gunter requires a single arrow to be supported by two rollers in cooperation with each other. The type of rest shown by Corley shows an arrow supported by a single roller, but there is no suggestion that a second roller could be added to support an additional arrow simultaneously in shooting position.

2. The system of claim 1 further comprising a horizontal adjustment means for independently adjusting said roller members in a horizontal direction.

3. The system of claim 2 in which said guide includes a bracket attached to the bow, said guide having a shaft on which each roller member rotates, said adjustment means comprising a bore in said bracket through which said shaft lockably horizontally slides thereby selectively positioning said roller in a horizontal direction.

4. The system of claim 1 further comprising a vertical adjustment means for adjusting said roller members in a vertical direction.

5. The system of claim 4 in which said guide includes a mounting bracket attached to the bow, said vertical adjustment means comprising a support upright selectively rotatably attached to said mounting bracket, said roller members rotatably attached to said support upright, said upright rotatable in the same plane as the bow whereby the vertical position of said roller members relative the bow changes relative the rotation of said support upright to said mounting bracket.

6. The system of claim 1 in which said guide further comprises a pair of parallel shafts on which said roller members rotate.

7. The system of claim 1 in which said roller members are comprised of nylon.

8. The system of claim 1 in which said bow has a bowstring, said guide adjustably attached to said bow to vary the location of said roller members between said bow and said bowstring whereby overdraw of the two arrows is controlled.

9. The arrow rest of claim 1 in which each said roller member comprises a roller having a circumferential channel having two sidewalls, said sidewalls adapted to guide an arrow during use.

10. A dual arrow overdraw rest for use in connection with a bow having a bowstring, said arrow rest comprising:

an elongate bracket member having a front end and rear end, said front end attached to said bow, said rear end extending toward the bowstring;

a pair of roller members vertically spaced apart from each other, one of said pair of roller members rotatably attached to said rear end of said bracket member; and adjustable spacing means to control the distance between said pair of rollers for controlling arrow targeting, said spacing means including a support rotatably attached to said bracket member, the other of said pair of rollers rotatably attached to said support, whereby relative spacing between said pair of rollers is altered by rotating said support.

11. The arrow rest of claim 10 in which said bracket member includes a plurality of holes through which an attachment bolt is selectively interfit to attach said bracket to the bow whereby said bracket member is adjustably connected to the bow and arrow overdraw is controlled.

12. The arrow rest of claim 10 in which said roller members comprise a pair of rollers having a circumferential channel having two sidewalls, said sidewalls adapted to guide the arrows during use.

13. The arrow rest of claim 10 in which said spacing means includes a shaft upon which each said roller rotates, said shafts lockably, slidably attached to one of said bracket and said support whereby relative horizontal spacing of said rollers changes by horizontally sliding said shafts.

14. A dual arrow draw system for shooting two arrows at once, said system comprising:

an archery bow;

an arrow guide adapted to guiding two arrows at the same time, said guide including a mounting bracket having a forward end and a rear end, said forward end attached to said bow, said rear end of said mounting bracket extending rearwardly away from said bow, a pair of vertically spaced parallel shafts attached to said rear end of said mounting bracket, and a roller rotatably attached to each said shaft whereby two arrows may be drawn and released from said bow simultaneously.

15. The system of claim 14 further comprising an adjustment means for independently adjusting said roller members in a horizontal direction.

16. The system of claim 15 in which said adjustment means includes a bore through which said shafts slide and lock screws interfit through said guide lockable to said shafts to selectively lock the position of said shafts through said bores.

17. The system of claim 14 in which said bow includes a bowstring, said guide adjustably attached to said bow to vary the location of said roller members between said bow and said bowstring whereby overdraw of the two arrows is controlled.

18. The arrow rest of claim 14 in which said roller members comprise a pair of rollers having an inwardly tapered circumferential channel having two sidewalls, said sidewalls adapted to guide and center the arrows during use.

* * * * *

UNITED STATES PATENT AND TRADEMARK OFFICE

CERTIFICATE OF CORRECTION

PATENT NO. : 5,327,877

DATED : July 12, 1994

INVENTOR(S) : Francis W. Shaw, III

It is certified that error appears in the above-identified patent and that said Letters Patent is hereby corrected as shown below:

Claim 1, column 6, lines 26-33, delete in their entirety.

Signed and Sealed this

Eleventh Day of October, 1994

*Attest:*

Bruce Lehman

BRUCE LEHMAN

*Attesting Officer*

*Commissioner of Patents and Trademarks*